US007451797B2

(12) United States Patent
Llagostera Forns

(10) Patent No.: US 7,451,797 B2
(45) Date of Patent: Nov. 18, 2008

(54) ARTICULATED ARM FOR AWNINGS

(75) Inventor: Joan Llagostera Forns, Reus (ES)

(73) Assignee: Llaza, S.A., Reus (Tarragona) (ES)

( * ) Notice: Subject to any disclaimer, the term of this patent is extended or adjusted under 35 U.S.C. 154(b) by 95 days.

(21) Appl. No.: 10/549,468

(22) PCT Filed: Aug. 1, 2003

(86) PCT No.: PCT/ES03/00404

§ 371 (c)(1),
(2), (4) Date: Sep. 14, 2005

(87) PCT Pub. No.: WO2005/017278

PCT Pub. Date: Feb. 24, 2005

(65) Prior Publication Data

US 2007/0051476 A1 Mar. 8, 2007

(51) Int. Cl.
*E04F 10/06* (2006.01)

(52) U.S. Cl. ..... 160/79; 160/70

(58) Field of Classification Search ..... 160/79, 160/70, 66, 67, 22, 68, 65, 69, 78; 135/88.11, 135/88.12
See application file for complete search history.

(56) References Cited

U.S. PATENT DOCUMENTS

| | | | | |
|---|---|---|---|---|
| 1,095,452 | A * | 5/1914 | Clarke | 160/70 |
| 1,815,199 | A * | 9/1931 | Goldberg et al. | 403/73 |
| 1,993,183 | A * | 3/1935 | Schane | 403/111 |
| 2,038,045 | A * | 4/1936 | Heiser | 160/70 |
| 2,123,828 | A * | 7/1938 | Gibson | 403/73 |
| 2,214,371 | A * | 9/1940 | Heiser | 403/73 |
| 2,252,109 | A * | 8/1941 | Ackerman | 403/120 |
| 2,299,067 | A * | 10/1942 | Anton | 403/120 |
| 5,369,919 | A * | 12/1994 | Lohausen | 52/73 |
| 6,557,612 | B2 * | 5/2003 | Voss | 160/79 |

FOREIGN PATENT DOCUMENTS

| | | |
|---|---|---|
| EP | 0 125 727 A | 11/1984 |
| EP | 1 051 839 U | 10/2002 |
| EP | 1 052 733 U | 2/2003 |
| WO | WO 98/01638 | 1/1998 |

OTHER PUBLICATIONS

International Search Report for PCT International Application No. PCT/ES03/00404 mailed Oct. 23, 2003.

* cited by examiner

*Primary Examiner*—David Purol
(74) *Attorney, Agent, or Firm*—RatnerPrestia

(57) ABSTRACT

An articulated arm for awnings is disclosed. It comprises an arm and a forearm connected by an articulated joint by means of respective articulation configurations at adjacent ends. The articulation configuration at the end of the forearm comprising a core with an exterior surface around a shaft, and the articulation configuration at the end of the arm comprising a surrounding wall around the core. A bearing is incorporated between the core and said wall to guide a relative rotation between the two. There is a flexible pulling element inside the arm, with a first end linked to an elastic element secured to a fixed point on the arm and a second end secured in the core. This element passes through a connection in the configuration and is partially housed in a space between the core and the wall.

14 Claims, 2 Drawing Sheets

ARTICULATED ARM FOR AWNINGS

This application is a U.S. National Phase Application of PCT International Application No. PCT/ES2003/000404, filed Aug. 1, 2003.

SCOPE OF THE INVENTION

This invention deals with an articulated arm for an awning that comprises an arm and a forearm that are mutually articulated by respective articulation configurations located at adjacent ends of the same, and pushed towards an open position by a flexible pulling elements that is linked to an elastic element housed inside the arm and linked to the cite articulation. The mentioned articulation configurations are designed so that the pulling element is completely out of sight and protected in any arm position.

BACKGROUND TO THE INVENTION

A general configuration is known for articulated arms for awnings that has become classic and according to which, the arm comprises an arm and forearm consisting of first and second tubular elements with parts at their ends connected to a plug defined by articulation configurations. The arm and forearm are connected together by an articulation consisting of two of the said adjacent articulation configurations. The articulation configuration joined to the arm includes a fork consisting of a pair of facing lugs containing coaxial holes, whereas the articulation configuration joined to the forearm defines a core with an axial hole aligned with the cited coaxial holes of the lugs for the insertion of an articulation pin. Within the first profile, which forms the arm body, there is a traction spring joined at one end to a fixed point on the first tubular profile and, by a second end to a flexible pulling element, which is, in turn, fixed to a point on the said core in the forearm articulation configuration and the said flexible pulling elements is supported on a surface of the core that is located away from the articulation's rotation shaft in order to create, in virtue of the tension exerted by the traction spring, a torque that will tend to maintain the arm and forearm in an open position.

In conventional designs, the cited flexible pulling element consists of one or more transmission chains, or one or more thick twisted cables, a portion of which is inevitable exposed and visible within the articulation zone. This exposure of the chain or cable involves the risk of dirt accumulating in the articulation zone and moreover, produces an anti-aesthetic effect in a product that is destined to be permanently in view of the public.

The application for international patent WO 98/01638 belonging to the current applicant makes known an articulated arm for the support of awnings that includes a series of improvements in the articulation configuration and where the mentioned flexible pulling element consists of a flat belt interiorly fitted with metal reinforcement filaments. This belt includes terminals at its two ends for joining the belt to the traction spring and the core respectively. The said terminals are shaped using casting technology and are joined to the said metal filaments, which project from the ends of the belt, during the casting process. In addition to greatly facilitating the assembly of the awning arm, this flat belt permits a more compact articulation design and can be made from plastic in the same colour as the rest of the arm so that it provides a sufficiently aesthetic appearance and can remain partially in view without any additional trim pieces being required.

Utility model ES-A-1052733 describes a model for an awning arm of this type in which the pulling element consists of a pair of thick twisted cables and where a curved top is employed to cover the sides of these twisted cables in an articulation zone. One inconvenience of such a design is that the thick cables produce an excessively wide articulation and the mentioned top is another part which adds to the complexity to the articulation and increases its cost.

One objective of this invention is that of providing an awning articulated arm in which the articulation between arm and forearm forms a compact, closed assembly, where the flexible pulling element is completely hidden from sight and protected by the articulation's own configurations.

A BRIEF DESCRIPTION OF THE INVENTION

The previous and other objectives are achieved in accordance with this invention by inverting the layout of the articulation configuration between the arm and forearm. Thus, in the articulated arm of this invention, the articulation configuration of the end of the forearm consists of a core with an exterior surface around a transversal shaft in the longitudinal direction of the forearm and the articulation configuration of the arm end consists of a wall surrounding the said core. Between the cited core and the said surrounding wall are included some means of bearings that guide rotation between both and provide support for the forearm on the arm.

The flexible pulling element in this case has the form of a flat belt as that described in the cited patent application WO 98/01638 and is terminated at the end closest to the articulation by a thickened configuration, which is fixed into the corresponding housing formed on the said exterior surface of the core. The surrounding wall has an interior surface that is separated from the core so that between both, there is a defined ring-shaped space that is sufficiently large to hold a portion of the flat belt supported on the core. The articulation configuration of the end of the arm includes a connection between the said ring-shaped space and an interior cavity in the arm for the said flexible pulling element.

The mentioned means of bearings include, according to a production example, at least one pair of first conical surfaces located close to, or on, the ends of the core and at least one pair of second conical surfaces that are combined with the first and designed to slide over them, located on, or close to, the entrances to an interior cavity defined by the surrounding wall. The articulation configurations may be produced by moulding a light metal alloy, such as an aluminum alloy, and at least one of the said first or second conical surfaces of each pair in contact with a material with low coefficient of friction in order to facilitate its sliding movement in contact with the other of the first or second conical surfaces of each pair in contact. The conical surfaces can be incorporated into some respective ring-shaped pieces of synthetic plastic material on the core or the surrounding wall, or may be respectively shaped onto the surrounding wall and core, in this case consisting of at least one of the first and/or second conical surfaces of each pair in contact with an anti-friction treatment of a coating of a material having a low coefficient of friction in order to prevent aluminum coming into contact with aluminum.

According to a production example, the articulation of the end of the forearm comprises a fork defined by first and second lateral supports that are facing each other, and between which the core is housed and fixed in place by means of at least one securing element axially inserted through at least one opening in at least one of the said first and second lateral supports. The core is inserted between the fork supports in a radial direction once the surrounding wall is mounted around the core so that when the core is then fitted to the fork, the wall surrounding the core becomes trapped by contact with between the first conical surfaces and the second conical surfaces.

According to another production example, the articulation configuration of the end of the forearm consists of a single lateral support from which the core projects, together with an end piece joined to the free and of the core by means of at least one securing element. One of the said first conical surfaces is located at the base of the core whereas the other of the said conical surfaces is incorporated into the base of the cited end piece. Here, the surrounding wall is arranged around the core in an axial direction, so that, when the end piece is then secured to the core, the surrounding wall is trapped between both first conical surfaces and with the second conical surfaces in contact with them.

In both production examples, the surrounding wall adapts at its ends to the supports formed by the fork or to the projecting core support and the end piece so that a closed housing is produced for the flexible pulling element and for the means of articulation bearings, which results in a more protected, safer articulation with a more aesthetic appearance.

In order to limit the rotation angle of the forearm in relation to the arm, the articulation comprises at least one pair of stops located on an interior surface of the surrounding wall in positions adapted to interfere with a protuberance on the exterior core surface during rotation of the forearm with respect to the arm. Obviously, the pair of stops could be on the said exterior core surface and the protuberance on the said interior surface of the surrounding wall with the same results. In this way, the rotation limiting device will also be hidden from view inside the articulation configuration.

A BRIEF DESCRIPTION OF THE DRAWINGS

The previous and other advantages and characteristics will become more evident with the following detailed description of some production examples with reference to the accompanying drawings, in which.

DETAILED DESCRIPTIONS OF SOME PRODUCTION EXAMPLES

Figure 1:
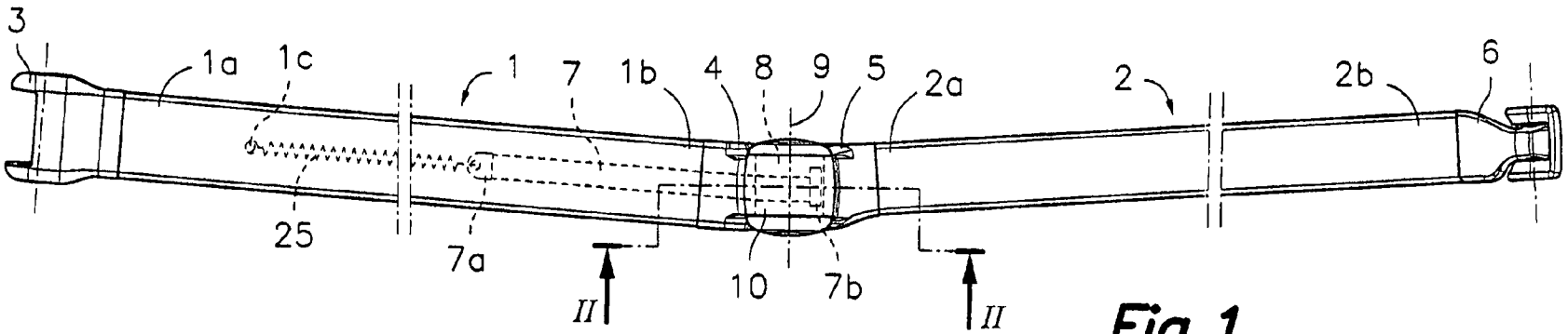
FIG. 1 is a side view of the articulated awning arm in accordance with a production example of this invention.

First referring to FIG. 1, the articulated arm for an awning in accordance with this invention comprises, as is usual, an arm 1, consisting of a tubular profile with first and second ends, 1*a*, 1*b* and a forearm 2, also consisting of the tubular profile with some first and second ends, 2*a*, 2*b*. The first end 1*a* of arm 1 is coupled to a part that defines a securing configuration 3 for the articulated joint to a fixed support (not shown). The second end 1*b* of arm 1 and the first end 2*a* of the forearm 2 are plugged into respective parts that define articulated configurations 4, 5 for a mutual articulated joint of arm 1 and forearm 2. Finally, the second end 2*b* of the forearm 2 is plugged into a part that defines a support configuration 6 for the articulated joint of forearm 2 to an awning load bar (not shown). Within a cavity inside arm 1, there is a flexible pulling element 7 (shown in broken lines) with a first end 7*a* linked to an elastic elements 25 secured to a fixed point 1*c* of arm 1 and a second end 7*b* secured to the cited articulation configuration 5 at the first end 2*a* of forearm 2.

The characteristic part of the articulated arm in this invention lies in the construction of the said mutual articulated joint between the arm 1 and forearm 2. In the production arm shown in FIGS. 1 to 3, the articulation configuration 5 of the first end 2*a* of forearm 2, which consists of the opposite of articulated arms for awnings under the current state of the technique, a core 8 that has an exterior surface around an shaft 9 that is transversal to the longitudinal direction of the forearm, while the articulation configuration 4 of the second end 1*b* of the arm 1 consists of a surrounding wall 10 placed around the said core 8. Between the core 8 and the cited surrounding wall 10 are incorporated some means of bearings 11*a*, 11*b*, 12*a* and 12*b* that are coaxial with the said shaft 9 for guiding the relative rotation between both and to provide support for the forearm 2 on the arm 1.

Figure 2:
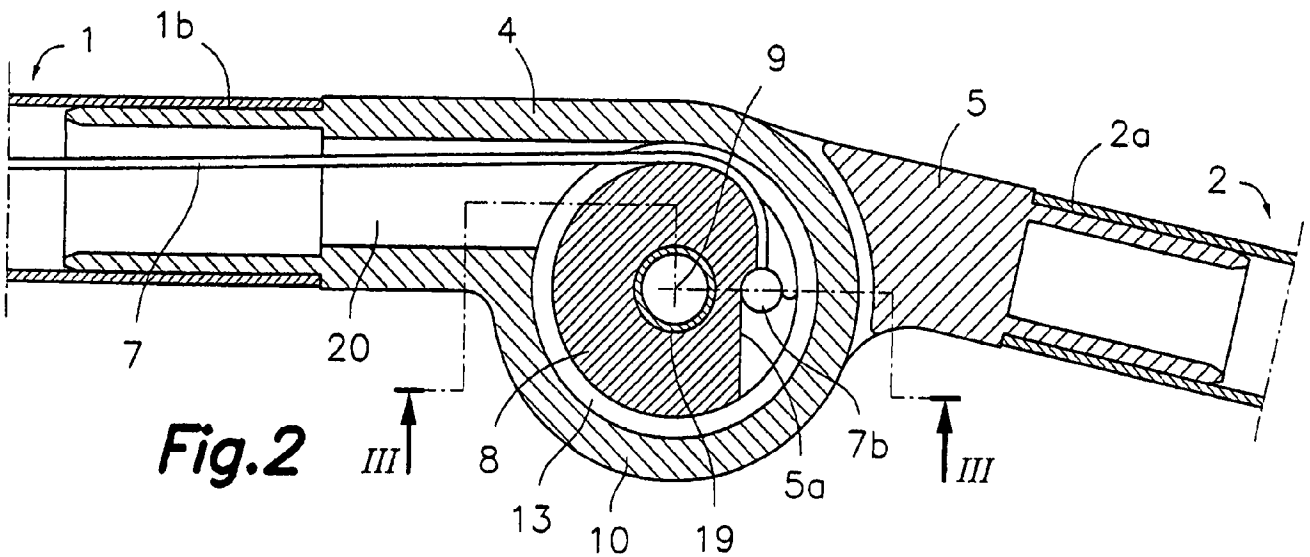
FIG. 2 is a partial transversal section view along plane II-II of FIG. 1.

As can be better seen in FIG. 2, between an interior surface of the surrounding wall 10 and core 8, there is a ring-shaped space 13, and the articulation configuration 4 of the second end 1*b* of the arm 1, includes an opening 20 between the said ring-shaped space 13 and the hollow cavity in the arm 1 for the said flexible pulling element 7. The flexible pulling element 7 is a flat plastic belt with internal metal filaments and is terminated at its first and second ends 7*a* and 7*b* by joint terminals shaped during the casting process. The terminal on the first end 7*a* has a configuration adapted to hook up with the elastic element 25, which is typically a helicoids spring working under tension, whereas the terminal on the second end 7*b* defines a thickened configuration that is secured inside a corresponding housing 5*a* incorporated on the said exterior surface of core 8, so that a portion of the pulling element 7 is supported on the exterior surface of the core 8. Since the exterior surface of core 8 is separated from the rotation shaft 9 of the articulation, the tension produced the elastic element 25 is transmitted by the pulling element 7 to the core 8, thus creating torque that tends to situate the arm in an open position.

Figure 3:
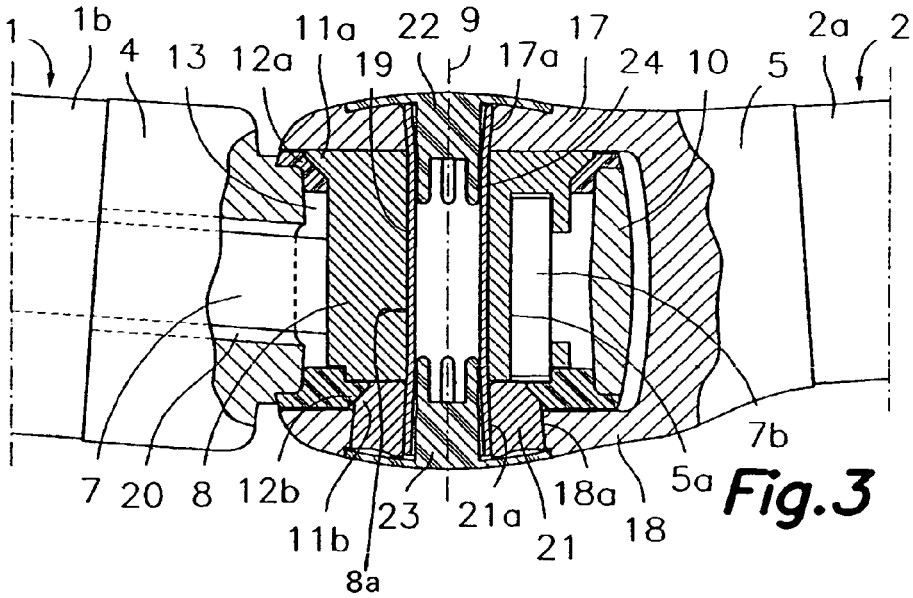
FIG. 3 is a partial transversal section view along plane III-III of FIG. 2.

Referring now to FIG. 3, the mentioned means of bearings 11*a*, 11*b*; 12*a*, 12*b* include at least one pair of first conical surfaces 11*a*, 11*b* located close to, or on, the ends of core 8 and at least one pair of second conical surfaces 12*a* and 12*b*, that are combined with the first and designed to slide over them, located on, or close to, the entrances to an interior cavity defined by the surrounding wall 10. In order to facilitate the sliding movement of the first conical surfaces 11*a*, 11*b* in contact with the second conical surfaces 12*a*, 12*b*, it is advantageous for at least on of the said first or second conical surfaces 11*a*, 11*b*; 12*a* 12*b*, of each pair in contact to be made of a material with a low coefficient of friction. In the illustrated production models, the second conical surfaces 12*a*, 12*b* are those made of low coefficient material and are incorporated into respective ring-shaped parts made of synthetic plastic on the surrounding wall 10, whereas the first conical surfaces 11*a* and 11*b* are directly made from core 8 material or core 8 support parts, which will be described in greater detail below. However, other configurations are possible for the conical surfaces functioning as bearings. For example, the first conical surfaces 11*a*, 11 *b* could be incorporated into detachable ring-shaped parts and the second conical surfaces 12*a*, 12*b* formed on the surrounding wall 10 or auxiliary parts fitted to it. Similarly, the first and the second conical surfaces

11*a*, 11*b*; 12*a*, 12*b* could be incorporated into detachable ring-shaped parts or could be shaped respectively into the material of the surrounding wall 10 and the core 8 or auxiliary parts fitted to them. In this case, since the parts that define the articulation configuration 4, 5 and the auxiliary parts are usually made of an aluminum alloy, at least one of the first and/or second conical surfaces 11*a*, 11*b* of each pair in contact will include either antifriction treatment of a coating of a material having o low coefficient of friction.

In the production example shown in FIGS. 1 to 3, the articulation configuration 5 of the first end 2*a* of forearm 2 consists of a fork defined by first and second lateral supports 17, 18, facing each other, and including respective aligned holes 17*a*, 18*a* and the core 8 includes a central hole 8*a* in an axial direction. The core 8 is located between the said first and second lateral supports 17, 18, which is fixed in place by a securing pin 19 that is axially inserted through holes 17*a* and 18*a* of the first and second supports 17 and 18 and the central hole 8*a* of core 8. In this case, the assembly of the pulling element 7 and the surrounding wall 10 around the core 8 is carried out before inserting the core 8 between the fork supports 17, 18, in a radial direction. When the core 8 is then secured to the fork supports 17, 18, the surrounding wall 10 around the core 8 becomes trapped by the contact of both first conical surfaces 11*a*, 11*b*, with the corresponding second conical surfaces 12*a*, 12*b*. These are fitted with the means of retaining the pin 19 within the said housing against any movement in an axial direction.

In the example illustrated in FIG. 3, the first lateral support 17 includes its corresponding first hole 17*a*, and one end of the core 8 close to the first lateral support 17 incorporates one of the first conical surfaces 11*a*, while the second hole 18*a* in the second lateral support 18 includes a slightly conical interior wall on which is seated a conical surface combined with a end part 21, which incorporates the other of the first conical surfaces 11*b* in a portion that projects towards the interior of one internal surface of the second support 18. The end part 21 is provided with a central hole 21*a* aligned with the central hole 8*a* of core 8 which, in turn, is aligned with the first hole 17*a* of the first lateral support 17. Pin 19 is inserted and retained inside the housing defined by the said central hole 21*a*, central hole 8*a* and the first hole 17*a*. The first hole 17*a* of the first lateral support 17 and the central hole 21*a* of the end part 21 have slightly conical central holes and the said pin 19, which is made of tubular metal, is opened at its ends against the said slightly conical interior surfaces of the first hole 17*a* and the central hole 21*a* respectively so that the pin is retained and the assembly strongly held together. Finally the articulation includes plugs 22, 23 for the first and second holes 17*a*, 18*a* of the first and second lateral supports 17, 18, with the said plugs 22, 23 fitted with securing configurations 24 inserted into the hollow pin 19 by pressure.

With the awning articulated arm of this invention as described above, an articulation between the arm and forearm is obtained that is both compact and closed, where the flexible pulling elements if completely hidden from view and protected by the actual configurations that form the articulation.

Figure 4:
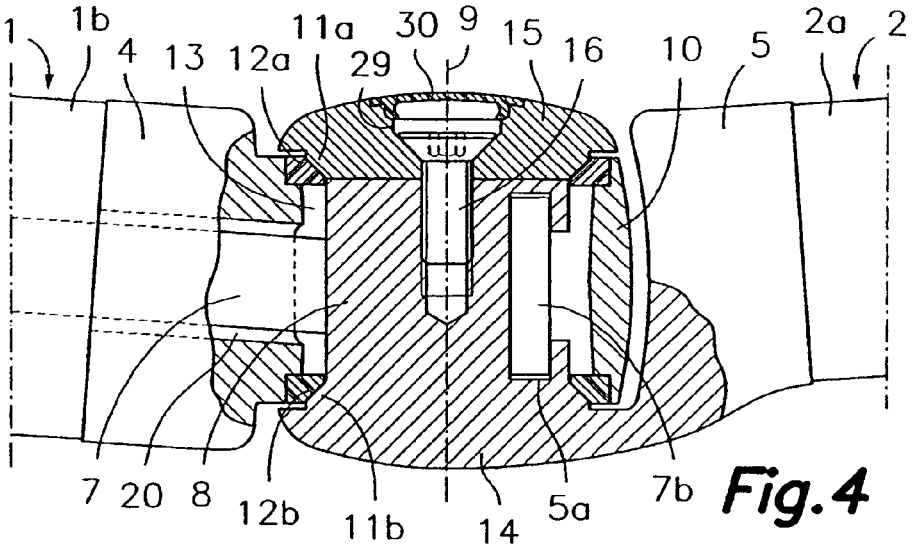
FIG. 4 is partial transversal section view similar to that of FIG. 3, showing another production example of the articulation.

FIG. 4 shows an alternative production example that only differs from the previous one in that the configuration 5 of the first end 2*a* of the forearm 2 comprises a single lateral support 14 from which core 8 projects, the base of which includes one of the said first conical surfaces 11*a*, 11*b*. An end part 15 that includes the other of the said conical surfaces 11*a*, 11*b* is joined to the free end of core 8 by means of at least one securing element 16, such as a screw through hole 29 in the end part 15. The second conical surfaces 12*a*, 12*b* are incorporated into respective ring-shaped parts housed in ribs on the surrounding wall 10, which is trapped between the two first conical surfaces 11*a*, 11*b* and with the second conical surfaces 12*a*, 12*b* in contact with them. Here, the assembly consists of fitting the pulling element 7 and then inserting the surrounding wall 10 around the core 8 and then fitting the end part 15 to core 8, which results in the surrounding wall 10 being trapped between both first conical surfaces 11*a*, 11*b* and with the second conical surfaces 12*a*, 12*b* in contact with them. Finally, a plug 30 is pressure inserted to close off hole 29 and hide the head of screw 16. The result is an articulation assembly that is equally compact and closed, but with a reduced number of parts.

Figure 5:
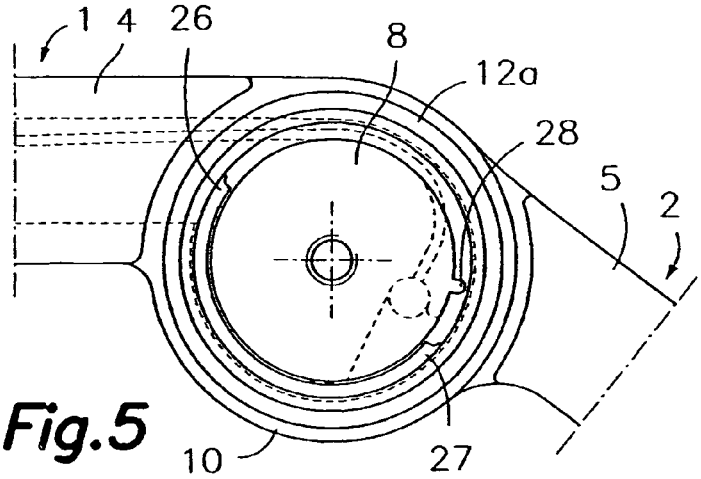
FIG. 5 is an overhead view of the articulation shown in FIG. 4 with the end piece removed to show the rotation limiting device.

FIG. 5 shows an internal rotation limiting device that is designed to limit the angle of rotation of forearm 2 in relation to arm 1. The device consists of at least one pair of stops 26, 27 located on an interior surface of surrounding wall 10, in positions adapted to interfere, during the rotation of forearm 2 in relation for arm 1, with a protuberance 28 on the exterior surface of core 8 intended to limit the angle of rotation of forearm 2 in relation to arm 1. It should be pointed out that the device would function in the same way with a reverse configuration, in other words, with a pair of stops 26, 27 on the said exterior surface of core 8 and the protuberance 28 on the said interior surface of the surrounding wall 10. In any case, it is significant that the device is also hidden from view and protected inside the articulation configurations 4 and 5.

The invention claimed is:

1. An articulated arm for an awning for use with a fixed support member and a load bar, the articulated arm comprising:

an arm having a first end and a second end, the first end of the arm including a securing portion adapted for coupling to the fixed support member, the second end of the arm including a surrounding wall portion adapted for articulation;

a forearm having a first end and a second end, the first end of the forearm including a core portion adapted for articulation and coupled to the second end of the arm, the core portion having an orifice extending at least partially through the core portion in a direction transverse to a longitudinal direction of the forearm, the second end of the forearm including a portion adapted for articulation and coupling to the load bar, and the surrounding wall portion of the arm at least partially disposed around the core portion;

an elastic element disposed within the arm and secured to a predetermined location on the arm;

a flexible pulling element disposed within the arm, the flexible pulling element having a first end coupled to the elastic element and a second end coupled to the core portion of the forearm; and bearing means disposed between the core and the surrounding wall, and coaxial with the orifice to guide rotation of the surrounding wall relative to the core portion and to support the forearm on the arm, wherein the surrounding wall portion and the core portion define an annular passage, and the second end of the arm includes an opening between the annular passage and a hollow interior portion of the arm for the passage of the flexible pulling element, said flexible pulling element terminates at the second end in a thickened portion secured to a receiver formed on the core portion, said bearings means include at least one pair of first conical surfaces positioned one of i) adjacent the end or ii) disposed on the end of the core portion, and at least one pair of second conical surfaces are disposed on the first conical surfaces and adapted to slide over the first conical surfaces, the second conical surfaces positioned one of adjacent or immediately adjacent an opening to the interior cavity.

2. An arm, in accordance with claim 1, wherein at least one of the first or second conical surfaces of each pair comprises a material with a low coefficient of friction in order to facilitate a sliding movement of the first conical surfaces relative to the second conical surfaces.

3. An arm, in accordance with claim 2, wherein at least one of the first and/or second conical surfaces are part of respective ring-shaped parts disposed at least one of inside the core portion or on the surrounding wall portion.

4. An arm, in accordance with claim 3, wherein said ring-shaped parts are made from synthetic plastic.

5. An arm, in accordance with claim 1, wherein at least one of the first conical surfaces and second conical surfaces is located respectively adjacent the surrounding wall portion and/or the core portion, and at least one of the first and/or second conical surfaces comprises either an antifriction treatment or a material having a low coefficient of friction.

6. An arm, in accordance with claim 1, wherein the first end of the forearm comprises a fork defined by first and second lateral support portions that face each other, between which the core portion is disposed and secured by a securing pin inserted axially through at least one hole in at least one of said first and second lateral supports, the surrounding wall portion disposed around the core portion, and the second conical surfaces in contact with the two first conical surfaces and with the surrounding wall portion.

7. An arm, in accordance with claim 6, further comprising:

at least one end part having a central hole formed there through; and a pin, wherein the first lateral support includes a first hole and one end of the core portion adjacent the first lateral support includes one of the first conical surfaces, and the second lateral support includes a second hole with a slightly conical interior surface on which is seated a first surface of the end part, a second surface of the end part comprising the other of the first conical surfaces, said central hole of said end part aligned with the orifice in the core, which is aligned with said first hole of the first lateral support, and the pin is inserted and retained in a housing defined by the central hole of the end part, the orifice in the core portion and the first hole in the first lateral support.

8. An arm, in accordance with claim 7, further comprising means for retaining said pin inside said housing against any movement in an axial direction.

9. An arm, in accordance with claim 8, wherein the first hole in the first lateral support and the central hole of the end part have slightly conical surfaces and said pin is tubular with end portions that are widened against said slightly conical interior surfaces of the first hole and the central hole respectively.

10. An arm, in accordance with claim 8, further comprising plugs for the first and second holes in the first and second lateral supports, with said plugs having securing configurations adapted for press fit into the hollow pin.

11. An arm, in accordance with claim 1, further comprising an end part, wherein the first end of the forearm comprises a lateral support that projects from the core portion, and the end part is coupled to a free end of the core portion by means of at least one securing element, where one of said first conical surfaces are disposed at the base of the core portion and another of said first conical surfaces is included into said end part, the second conical surfaces disposed between the surrounding wall and the two first conical surfaces.

12. An arm, in accordance with claim 1, further comprising at least one pair of stops located on an interior surface of the surrounding wall portion or on said exterior surface of the core portion, in positions adapted to interfere during rotation of the forearm with respect to the arm, with a protuberance on the exterior surface of the core portion or said interior surface of the surrounding wall portion in order to limit an angle of rotation of the forearm with respect to the arm.

13. An arm, in accordance with claim 9, further comprising plugs for the first and second holes in the first and second lateral supports, with said plugs having securing configurations adapted for press fit into the hollow pin.

14. An arm, in accordance with claim 1, wherein said flexible pulling element is a belt that terminates at the second end in a thickened portion secured to a receiver formed on the core.

* * * * *